US009472163B2

(12) United States Patent
Gould et al.

(10) Patent No.: US 9,472,163 B2
(45) Date of Patent: Oct. 18, 2016

(54) ADJUSTING CONTENT RENDERING FOR ENVIRONMENTAL CONDITIONS

(75) Inventors: David A. Gould, Andover, MA (US); Geoffrey W. Greve, Swansea, MA (US)

(73) Assignee: Monotype Imaging Inc., Woburn, MA (US)

( * ) Notice: Subject to any disclaimer, the term of this patent is extended or adjusted under 35 U.S.C. 154(b) by 0 days.

(21) Appl. No.: 13/399,310

(22) Filed: Feb. 17, 2012

(65) Prior Publication Data

US 2013/0215133 A1 Aug. 22, 2013

(51) Int. Cl.
*G09G 5/00* (2006.01)
*G09G 5/10* (2006.01)

(52) U.S. Cl.
CPC ..... *G09G 5/10* (2013.01); *G09G 2320/08* (2013.01); *G09G 2360/144* (2013.01)

(58) Field of Classification Search
CPC ..... G09G 5/02; G09G 5/10; G09G 2320/00; G09G 2320/06; G09G 2320/0606; G09G 3/3406; G09G 2300/0456; G09G 2360/144; G09G 2320/062; G09G 3/34; G09G 2360/14; G09G 2320/0613; G09G 23/34; G06F 1/3218
See application file for complete search history.

(56) References Cited

U.S. PATENT DOCUMENTS 5,170,442 A * 12/1992 Murai ..... G06K 15/02 382/258
5,684,510 A * 11/1997 Brassell ..... G06T 11/203 345/443
5,715,473 A * 2/1998 Reed ..... G06F 17/214 715/210
5,724,456 A * 3/1998 Boyack et al. ..... 382/274
5,781,687 A * 7/1998 Parks ..... G11B 27/028 348/E5.06
5,956,157 A * 9/1999 Tai ..... 358/3.24
6,947,017 B1 * 9/2005 Gettemy ..... 345/63
7,443,466 B2 * 10/2008 Dedene et al. ..... 349/106
7,535,471 B1 * 5/2009 Mansfield ..... G06T 11/203 345/467
7,696,995 B2 * 4/2010 McTaggart ..... 345/426
7,880,746 B2 * 2/2011 Marks et al. ..... 345/589
7,965,859 B2 * 6/2011 Marks ..... 382/100
8,130,204 B2 * 3/2012 Tschirhart ..... 345/173
8,279,349 B2 * 10/2012 Shmueli et al. ..... 348/645
8,494,507 B1 * 7/2013 Tedesco et al. ..... 455/418

(Continued)

FOREIGN PATENT DOCUMENTS

EP 1571485 A2 * 9/2005
EP 2028640 A2 * 2/2009

OTHER PUBLICATIONS

Yamauchi, Pixel Circuit and Display Apparatus (WO2011052272), 2011.*

(Continued)

*Primary Examiner* — Devona Faulk
*Assistant Examiner* — Charles L Beard
(74) *Attorney, Agent, or Firm* — Fish & Richardson P.C.

(57) ABSTRACT

A system includes a computing device that includes a memory configured to store instructions. The computing device also includes a processor to execute the instructions to perform a method that includes receiving information representative of one or more environmental conditions. The method also includes determining one or more adjustments for rendering content on one or more electronic displays based upon the received information representative of the one or more environmental conditions, and, adjusting the rendering of the content for being presented on at least one display based upon the received information representing the one or more environmental conditions.

27 Claims, 6 Drawing Sheets

(56) References Cited

U.S. PATENT DOCUMENTS 8,538,144 B2 * 9/2013 Benitez et al. ..... 382/167
8,749,478 B1 * 6/2014 Bowen ..... G09G 5/003 345/107
8,933,958 B2 * 1/2015 Luengen et al. ..... 345/606
2001/0043277 A1 * 11/2001 Tanaka et al. ..... 348/333.01
2002/0021292 A1 * 2/2002 Sakashita ..... G09G 3/3406 345/204
2002/0167467 A1 * 11/2002 Kao et al. ..... 345/60
2003/0105547 A1 * 6/2003 Haight ..... H01L 21/67288 700/121
2004/0070565 A1 * 4/2004 Nayar ..... G06K 9/4661 345/156
2004/0183828 A1 * 9/2004 Nichogi et al. ..... 345/745
2005/0162415 A1 * 7/2005 Chen et al. ..... 345/207
2005/0212824 A1 * 9/2005 Marcinkiewicz et al. .... 345/690
2006/0044234 A1 * 3/2006 Shimonishi ..... 345/77
2006/0077169 A1 * 4/2006 Fujikawa ..... G09G 3/3233 345/102
2006/0092182 A1 * 5/2006 Diefenbaugh et al. ..... 345/690
2006/0109266 A1 * 5/2006 Itkowitz ..... G06F 3/016 345/419
2006/0188132 A1 * 8/2006 Shigeta ..... 382/115
2006/0239127 A1 * 10/2006 Wu ..... 368/276
2006/0284895 A1 * 12/2006 Marcu ..... G09G 3/20 345/690
2007/0126657 A1 * 6/2007 Kimpe ..... 345/55
2007/0146863 A1 * 6/2007 Suh et al. ..... 359/279
2007/0162195 A1 * 7/2007 Garceau et al. ..... 701/3
2007/0195519 A1 * 8/2007 Shin et al. ..... 362/125
2007/0257928 A1 * 11/2007 Marks et al. ..... 345/581
2007/0270669 A1 * 11/2007 Parnagian ..... 600/301
2007/0279427 A1 * 12/2007 Marks ..... 345/581
2007/0288844 A1 * 12/2007 Zingher ..... G06T 11/60 715/210
2008/0036591 A1 * 2/2008 Ray ..... 340/540
2008/0123000 A1 * 5/2008 Lin et al. ..... 349/33
2008/0262722 A1 * 10/2008 Haag et al. ..... 701/208
2009/0002563 A1 * 1/2009 Barnhoefer et al. ..... 348/673
2009/0010537 A1 * 1/2009 Horie ..... G09G 5/02 382/167
2009/0069953 A1 3/2009 Hale et al.
2009/0109171 A1 * 4/2009 Akaiwa ..... G09G 3/344 345/107
2009/0174636 A1 * 7/2009 Kohashikawa et al. ..... 345/87
2009/0219244 A1 * 9/2009 Fletcher ..... G09G 3/3406 345/102
2009/0225065 A1 * 9/2009 Overes ..... 345/207
2009/0267780 A1 * 10/2009 Van Hoff et al. ..... 340/635
2009/0303215 A1 * 12/2009 Shiozaki ..... G09G 3/3406 345/207
2010/0026682 A1 * 2/2010 Plowman et al. ..... 345/419
2010/0079426 A1 * 4/2010 Pance et al. ..... 345/207
2010/0103186 A1 * 4/2010 Luengen et al. ..... 345/589
2010/0114923 A1 * 5/2010 McVady ..... G06F 17/30905 707/758
2010/0123597 A1 * 5/2010 Kitsukawa ..... G06F 1/1626 345/173
2010/0141571 A1 * 6/2010 Chiang et al. ..... 345/102
2010/0149145 A1 * 6/2010 Van Woudenberg .... G09G 3/34 345/207
2010/0225640 A1 * 9/2010 Vieri ..... G06F 1/3218 345/214
2010/0228735 A1 * 9/2010 Hsu ..... 707/746
2010/0245212 A1 * 9/2010 Dallas et al. ..... 345/32
2010/0321377 A1 * 12/2010 Gay et al. ..... 345/419
2011/0037576 A1 * 2/2011 Jeon ..... G06F 1/1626 340/407.2
2011/0050695 A1 * 3/2011 Sullivan et al. ..... 345/426
2011/0095875 A1 * 4/2011 Thyssen ..... G09G 5/10 340/407.1
2011/0096048 A1 * 4/2011 Diefenbaugh et al. ..... 345/207
2011/0102451 A1 * 5/2011 Broga et al. ..... 345/589
2011/0131153 A1 * 6/2011 Grim, III ..... G06F 9/4445 705/400
2011/0141159 A1 * 6/2011 Takeuchi ..... 345/690
2011/0193876 A1 * 8/2011 Handa et al. ..... 345/595
2011/0205397 A1 * 8/2011 Hahn et al. ..... 348/231.6
2011/0210942 A1 9/2011 Kitamori et al.
2011/0254819 A1 * 10/2011 Yamagishi ..... G09G 3/20 345/207
2011/0285746 A1 * 11/2011 Swic ..... 345/597
2011/0310446 A1 * 12/2011 Komatsu ..... 358/518
2012/0050306 A1 * 3/2012 Kurzweil ..... G06T 11/60 345/589
2012/0081279 A1 * 4/2012 Greenebaum et al. ..... 345/156
2012/0135783 A1 * 5/2012 Sams ..... 455/556.1
2012/0182276 A1 * 7/2012 Kee ..... G09G 5/10 345/207
2012/0268436 A1 * 10/2012 Chang ..... G09G 3/34 345/207
2012/0287113 A1 * 11/2012 Uehata et al. ..... 345/212
2012/0287271 A1 * 11/2012 Holland et al. ..... 348/143
2012/0293528 A1 * 11/2012 Larsen ..... 345/589
2013/0078976 A1 * 3/2013 Naftolin ..... 455/418
2013/0222354 A1 * 8/2013 Koivunen ..... G09G 3/3611 345/207

OTHER PUBLICATIONS

International Search Report & Written Opinion, PCT/US2013/026042, mailed May 16, 2013, 10 pages.

* cited by examiner

ADJUSTING CONTENT RENDERING FOR ENVIRONMENTAL CONDITIONS

BACKGROUND

This description relates to techniques for adjusting the rendering of content based upon environmental conditions.

With the increased use of electronically presented content for conveying information, more electronic displays are being incorporated into objects (e.g., vehicle dashboards, entertainment systems, cellular telephones, eReaders, etc.) or produced for stand alone use (e.g., televisions, computer displays, etc.). With such a variety of uses, electronic displays may be found in nearly every geographical location for stationary applications (e.g., presenting imagery in homes, offices, etc.), mobile applications (e.g., presenting imagery in cars, airplanes, etc.), etc. Further, such displays may be used for presenting various types of content such as still imagery, textual content such as electronic mail (email), documents, web pages, electronic books (ebooks), magazines and video along with other types of content such as audio.

SUMMARY

The systems and techniques described here relate to appropriately adjusting the rendering of content based upon environmental conditions and/or potentially other types of data to dynamically provide a reasonably consistent viewing experience to a viewer.

In one aspect, a computing device-implemented method includes receiving information representative of one or more environmental conditions. The method also includes determining one or more adjustments for rendering content on one or more electronic displays based upon the received information representative of the one or more environmental conditions, and, adjusting the rendering of the content for being presented on at least one display based upon the received information representing the one or more environmental conditions.

Implementations may include one or more of the following features. Adjusting the rendering of the content may include adjusting one or more rendering parameters. The content for being presented on the at least one display may include graphics, text, or other types of individual content or combinations of content. At least one of the environmental conditions may be collected from a sensor or multiple sensors that employ one or more sensing techniques. At least one of the environmental conditions may be user-provided or provided from another source or a combination of sources. At least one of the environmental conditions may represent ambient light or another type of condition or multiple conditions. At least one of the environmental conditions may represent an artificial light source or other type of source. The artificial light source may be a computing device or other type of device. The one or more electronic displays may include a printer.

In another aspect, a system includes a computing device that includes a memory configured to store instructions. The computing device also includes a processor to execute the instructions to perform a method that includes receiving information representative of one or more environmental conditions. The method also includes determining one or more adjustments for rendering content on one or more electronic displays based upon the received information representative of the one or more environmental conditions, and, adjusting the rendering of the content for being presented on at least one display based upon the received information representing the one or more environmental conditions.

Implementations may include one or more of the following features. Adjusting the rendering of the content may include adjusting one or more rendering parameters. The content for being presented on the at least one display may include graphics, text, or other types of individual content or combinations of content. At least one of the environmental conditions may be collected from a sensor or multiple sensors that employ one or more sensing techniques. At least one of the environmental conditions may be user-provided or provided from another source or a combination of sources. At least one of the environmental conditions may represent ambient light or another type of condition or multiple conditions. At least one of the environmental conditions may represent an artificial light source or other type of source. The artificial light source may be a computing device or other type of device. The one or more electronic displays may include a printer.

In another aspect, one or more computer readable media storing instructions that are executable by a processing device, and upon such execution cause the processing device to perform operations that include receiving information representative of one or more environmental conditions. Operations also include determining one or more adjustments for rendering content on one or more electronic displays based upon the received information representative of the one or more environmental conditions, and, adjusting the rendering of the content for being presented on at least one display based upon the received information representing the one or more environmental conditions.

Implementations may include one or more of the following features. Adjusting the rendering of the content may include adjusting one or more rendering parameters. The content for being presented on the at least one display may include graphics, text, or other types of individual content or combinations of content. At least one of the environmental conditions may be collected from a sensor or multiple sensors that employ one or more sensing techniques. At least one of the environmental conditions may be user-provided or provided from another source or a combination of sources. At least one of the environmental conditions may represent ambient light or another type of condition or multiple conditions. At least one of the environmental conditions may represent an artificial light source or other type of source. The artificial light source may be a computing device or other type of device. The one or more electronic displays may include a printer.

These and other aspects and features and various combinations of them may be expressed as methods, apparatus, systems, means for performing functions, program products, and in other ways.

Other features and advantages will be apparent from the description and the claims.

DETAILED DESCRIPTION

Figure 1:
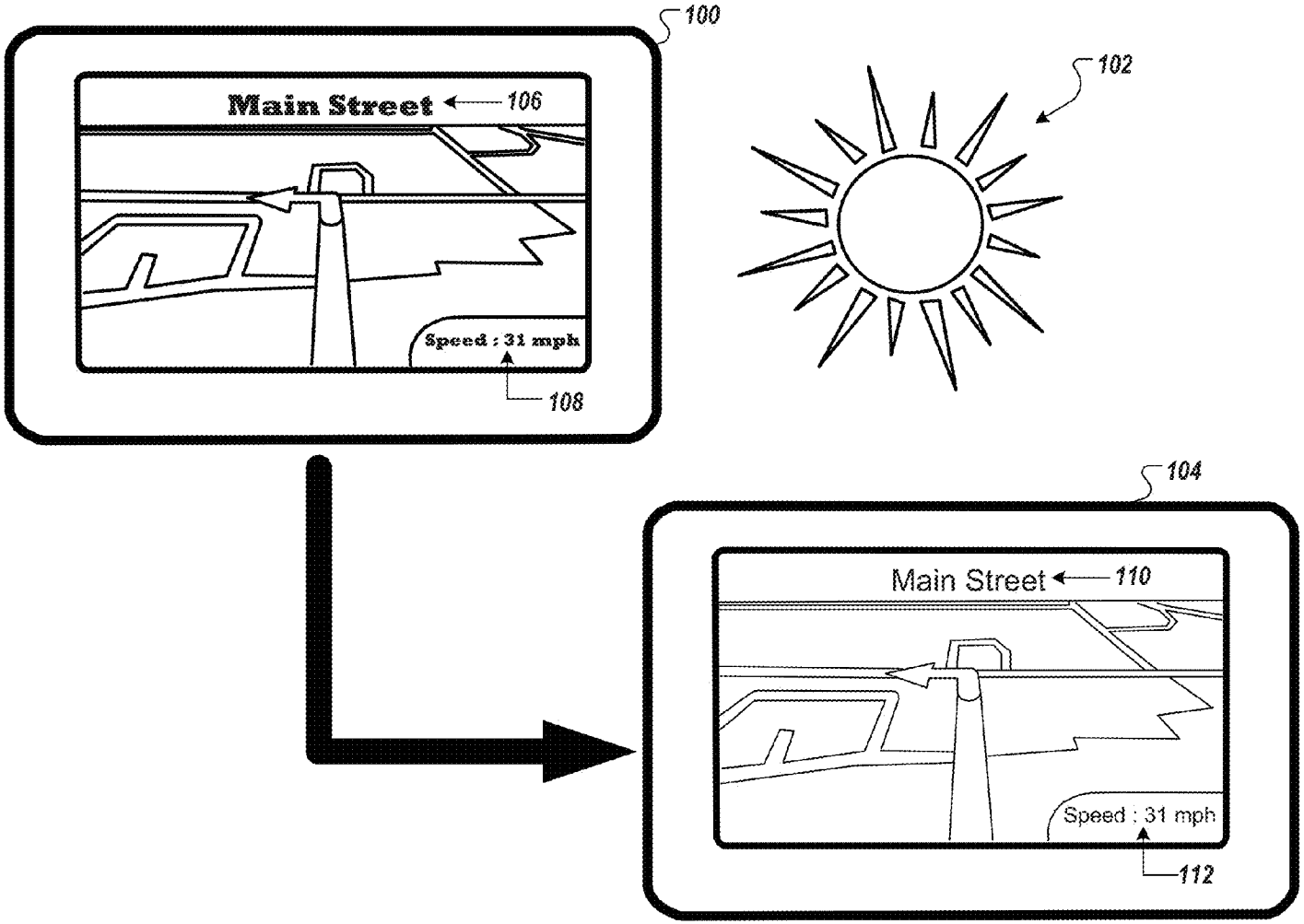
FIG. 1 illustrates adjusting the rendering of content based upon environmental conditions.

Referring to FIG. 1, with the ever-growing need for information and staying informed, electronic displays are being incorporated into more and more platforms and systems along with being frequently used in standalone applications. Through the expanded use, the displays can be considered as being more exposed to environmental conditions that can affect the content being presented on the displays. Lighting conditions that change over time (e.g., due to the daily and seasonal movement of the sun) can degrade the viewing experience provided by a display. For example, as illustrated in the figure, a portable navigation system (e.g., incorporated into the dashboard of a vehicle, being carried by an individual, etc.) may be asked to operate under dynamically changing environmental conditions. In this illustration, the portable navigation system may be moved into a position such that the viewing experience provided by its electronic display 100 is obscured (e.g., incident sunlight 102 washes out the presented content). To counteract the effects of the incident sunlight 102, operations may be executed (e.g., by the portable navigation system) to reduce the effects of this environmental condition. For example, properties and parameters (e.g., backlighting, etc.) associated with the electronic display 100 may be adjusted. The effects may also be reduced by adjusting the conversion of the content from digital form into a visual form, e.g., rendering of the content, for presenting on the display 100 to substantially retain visual consistency and legibility of the content. In this example, to combat the increased glare due to the sunlight 102, the sharpness of the presented content may be increased (e.g., presented with crisper boundaries between zones of different tones or colors). To illustrate such an adjustment, an adjusted electronic display 104 is rendered and presented in which sharpness has been increased to aid the viewer. Narrowed and more distinct lines are used to represent the navigation path presented in the adjusted electronic display 104. Similarly, textual information included in the display 104 is sharper (e.g., compared to the original text of the electronic display 100). In this example, other rendering adjustments are also applied to the text of the electronic display 100, for example, the font used to present the textual content is changed based upon the environmental condition. As illustrated in the figure, to improve the visibility of text, the font used in display 100 (e.g., for text 106 and 108) has been changed as shown in display 104 (e.g., for corresponding text 110 and 112). Similarly, other types of rendering adjustments may be executed to account for different environment conditions that may impact the viewing experience of the presented content.

Figure 2:
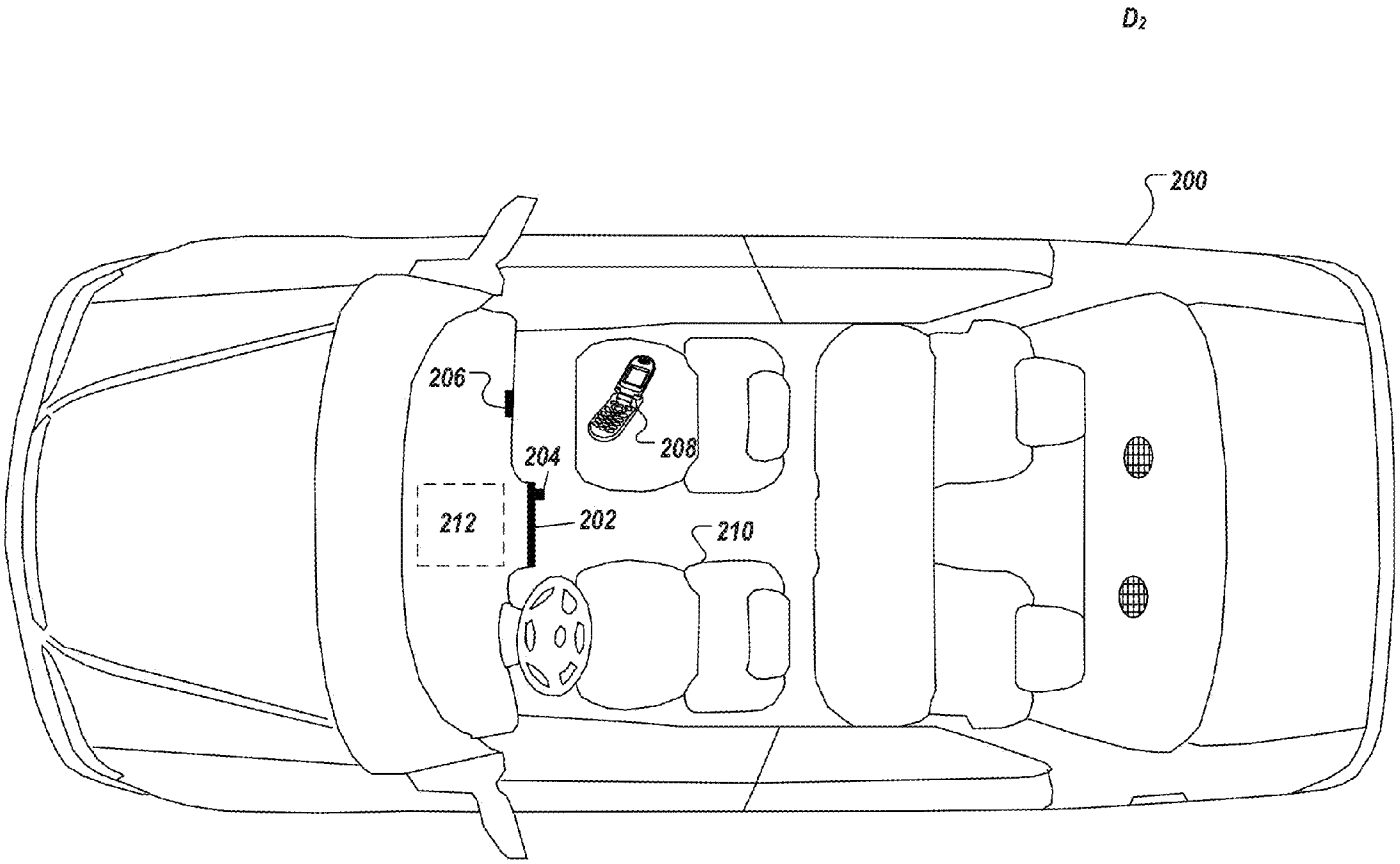
FIGS. 2 and 3 illustrate devices and platforms capable of adjusting the rendering of content based upon environmental conditions.

Referring to FIG. 2, a top view of a vehicle 200 is illustrated to demonstrate some environmental conditions that may be experienced and could potentially hinder the viewing experience provided on an electronic display. Along with changes in ambient light due to the time of day and season, other changes in incident sunlight and other types of lighting conditions may be experienced by the vehicle. For example, as the vehicle 200 is maneuvered and driven in different directions relative to the position of the sun of other lighting sources (e.g., lamp posts, street lights, etc.), different levels of incident light levels may be experienced (e.g., from various azimuth and elevation angles). Driving down a road with the sun beaming from different angles as the road curves may cause different lighting conditions. Similarly, having the sunlight (or light from other sources) partially or fully blocked in a repetitive manner as the vehicle passes trees, buildings and other types of structures or objects may dynamically change the light incident on one or more electronic displays incorporated into the vehicle 200. In this illustration the vehicle 200 includes an electronic display 202 that has been incorporated into its dashboard, however one or more displays incorporated into other locations or other types of displays (e.g., a head's up display projected onto a windshield, window, etc.) may similarly experience such environmental conditions. To interact with the electronic display 202, a knob 204 illustrates a potential control device; however, one or more other types of devices may be used for user interaction (e.g., a touch screen display, etc.).

To sense environmental conditions that may affect the presentation of content, one or more techniques and methodology may be implemented. For example, one or more types of sensing techniques may be used for collecting information reflective of environmental conditions experienced by electronic displays. For example, passive and active senor technology may be utilized to collect information regarding environmental conditions. In this illustrated example, a sensor 206 (e.g., light sensor) is embedded into the dashboard of the vehicle 200 at a location that is relatively proximate to the electronic display 202. In some arrangements, one or more such sensors may be located closer or farther from the electronic display. Sensors may also be included in the electronic display itself; for example, one or more light sensors may be incorporated such that their sensing surfaces are substantially flush to the surface of the electronic display. Sensors and/or arrays of sensors may be mounted throughout the vehicle 200 for collecting such information (e.g., sensing devices, sensing material, etc. may be embedded into windows of the vehicle, mounted onto various internal and external surfaces of the vehicle, etc.). Sensing functionality may also be provided from other devices, for example, which include sensors not incorporated into the vehicle. For example, the sensing capability of computing devices (e.g., a cellular telephone 208) may be exploited for collecting environmental conditions. Once collected, the computing device may provide the collected information for accessing the environmental conditions (e.g., incident ambient light) being experienced by the electronic display. In the illustrated example, the cellular telephone 208 may collect and provide environmental condition information to access the current conditions being experienced by the electronic display 202. To provide this information various types of technology may be used; for example, one or more wireless links (e.g., radio frequency, light emissions, etc.) may be established and protocols (e.g., Bluetooth, etc.) used to provide the collected information.

Along with natural conditions (e.g., ambient light, etc.), environment conditions may also include other types of information. For example, information associated with one or more viewers of the electronic display may be collected and used for presenting content. Viewer-related information may be collected, for example, from the viewer or from information sources associated with the viewer. With reference to the illustrated vehicle 200, information may be collected for estimating the perspective at which the viewer sees the electronic display 202. For example, information may be provided based upon actions of the viewer (e.g., the position of a car seat 210 used by the viewer, any adjustments to the position of the seat as controlled by the viewer, etc.). In some arrangements, multiple viewers (e.g., present in the vehicle 200) may be monitored and one or more displays may be adjusted (e.g., adjust the content rendering on the respective display being viewed). For example, a head's up display may be adjusted for the driver of a vehicle while a display incorporated into the rear of the driver's seat may be adjusted for a backseat viewer. Viewer activity may also be considered an environmental activity that can be monitored and provide a trigger event for adjusting the rendering of content on one or more displays. Such activities may be associated with controlling conditions internal or external to the vehicle 200 (e.g., weather conditions, time of day, season of year, etc.). For example, lighting conditions within the cabin of the vehicle 200 (e.g., turning on or more lights, raising or lowering the roof for a convertible vehicle, etc.) may be controlled by the viewer and used to represent the environmental conditions. In some arrangements, viewer activities may also include relatively simple viewer movements. For example, the eyes of a viewer (e.g., driver of a vehicle) may be tracked (e.g., by a visual eye tracking system incorporated into the dash board of a vehicle) and corresponding adjustments executed to the rendering of display content (e.g., adjusting content rendering during time periods when the driver is focused on the display).

Other information may also be collected that is associated with one or more viewers of the electronic display. For example, characteristics of each viewer (e.g., height, gender, location in a vehicle, one or more quantities representing their eyesight, etc.) and information that represents additional information about the viewer's vision (e.g., viewer wears proscription glasses, contacts, sunglasses, has one or more medical conditions, etc.). Viewer characteristics may also be collected from the viewer, compared to being actively provided from the viewer. For example, a facial recognition system (e.g., incorporated into the vehicle, a device residing within the vehicle, etc.) may be used to detect the face of one or more viewers (e.g., the driver of the vehicle). The facial expression of the viewer may also be identified by the system and corresponding action taken (e.g., if the viewer's eyes are squinted or if an angry facial expression is detected, appropriately adjust the rendering of the content presented on the electronic display). One or more feedback techniques may be implemented to adjust content rendering based upon, for example, viewer reaction to previous adjustments (e.g., the facial expression of an anger viewer changes to indicate pleasure, more intense anger, etc.). Other types of information may also be collected from the viewer; for example, audio signals such as speech may be collected (e.g., from one or more audio sensors) and used to determine if content rendering should be adjusted to assist the viewer. Other types of audio content may also be collected; for example, audio signals may be collected from other passengers in the vehicle to determine if rendering should be adjusted (e.g., if many passengers are talking in the vehicle the content rendering may be adjusted to ease the driver's ability to read the content). Audio content may also be collected external to the vehicle to provide a measure of vehicle's environment (e.g., in a busy urban setting, in a relatively quiet rural location, etc.). Position information provided from one or more systems (e.g., a global positioning system (GPS)) present within the vehicle and/or located external to the vehicle, may be used to provide information regarding environmental conditions (e.g., position of the vehicle) and used to determine if content rendering should be adjusted. In this particular example, a content rendering engine 212 is included within the dashboard of the vehicle 200 and processes the provided environmental information and correspondingly adjusts the presented content, if needed. One or more computing devices incorporated into the vehicle 200 may provide a portion of the functionality of the content rendering engine 212. Computing devices separate from the vehicle may also be used to provide the functionality; for example, one or more computing devices external to the vehicles (e.g., one or more remotely located servers) may be used in isolation or in concert with the computational capability included in the vehicle. One or more devices present within the vehicle (e.g., cellular telephone 208) may be utilized for providing the functionality of the content rendering engine 212.

Environmental conditions may also include other types of detected information, such as detecting information associated with the platform within which content is being displayed. For example, similar to detecting changes in sunlight while being driven, objects such as traffic signs, construction site warning lights, store fronts, etc. may be detected (e.g., by one or more image collecting devices incorporated into the exterior or interior of a vehicle) and have representations prepared for presenting to occupants of the vehicle (e.g., the driver). Based upon the identified content, the rendering of the corresponding representations may be adjusted, for example to quickly grab that attention of the vehicle driver (e.g., to warn that the vehicle is approaching a construction site, a potential or impending accident with another car, etc.). In some arrangements, input provided by an occupant (e.g., indicating that he is interested in finding a particular restaurant, style of restaurant, etc.) may be used to signify when rendering adjustments should be executed (e.g., when a Chinese restaurant is detected by the vehicle cameras, rending is adjusted to alert the driver to the nearby restaurant).

Figure 3:
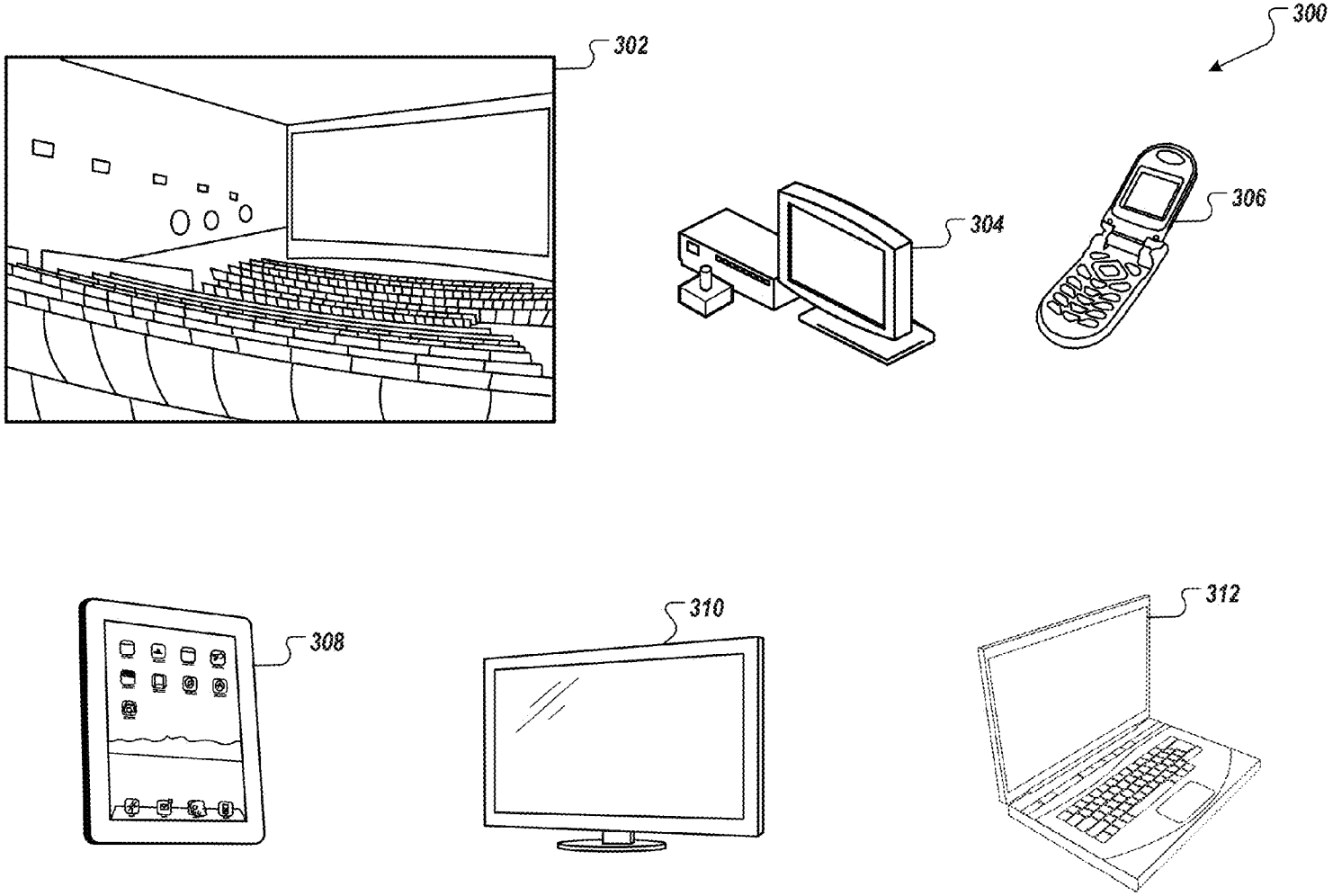

Referring to FIG. 3, a collection 300 of potential systems, platforms, devices, etc. is illustrated that may present content that is adjusted based upon environmental conditions. For example, content (e.g., graphics, text, etc.) that is presented on one or more large electronic displays in a multiple viewer venue 302 (e.g., movie theater, sporting stadium, concert hall, etc.) may be adjusted based upon environmental conditions. Content may be rendered in one manner for one environmental condition (e.g., normal ambient lighting conditions as viewers are being seated) and rendered in another manner for another environmental condition (e.g., after the house lights have been significantly dimmed for presenting a feature film or other type of production). As such, rendering may be adjusted to assist the viewers for reading content (e.g., presenting an emergency message to all viewers) under dynamically changing environment conditions of the venue. Content being presented by a gaming console 304 (or one or more similar devices) may be adjusted for one or more environment conditions. As such, content may be adjusted based upon changing lighting conditions (e.g., a light is inadvertently turned on). Content adjustments (e.g., rendering adjustments) may also be based upon actions of the player, for example, if the viewer is being physically active to interact with a game title (e.g., the motion of the player is detected and used during game play), the rendering of the content may be adjusted to improve the active player's ability to recognize (e.g., read) the presented content. Hand held devices such as a cellular telephone 306, a tablet computing device 308, a smart device, etc. may execute operations of a content rendering engine for adjusting presented content for changing environmental conditions. For example, as a viewer carries such a device from an indoor location (e.g., an office building) to an outdoor location (e.g., a parking lot), environmental conditions such as light levels may drastically change (e.g., ambient light levels may increase on a sunny day, decrease at night, etc.). In another example, another type of hand held device (e.g., an eReader) might incorporate one or more sensors (e.g., light sensors) for detecting light levels for adjusting the rendering of the text being presented by the device. Such hand held devices may also include other sensors for detecting environmental conditions. For example, motion sensors (e.g., accelerometers), view position sensors (e.g., for detecting the position, angle, etc. of a reader's eyes relative to the device's screen, etc.) may be used to collect information for adjusting the rendering of text for presentation on the device. Similarly, a television 310 or different types of computing devices (e.g., a laptop computer system 312) may also experience changing environmental conditions that could hinder a viewer's ability to comprehend content presented on their corresponding electronic displays. By accounting for changing environmental conditions, presented content can be dynamically adjusted to improve legibility and potentially reduce the probability of dangerous situations. For example, by adjusting content due for environmental conditions, a vehicle driver may not inadvertently focus on an electronic display for an extended period to view obscured content adjusted, thereby creating a potentially dangerous situation. Adjusting the rendering of content on one or more displays may also include medical devices, safety equipment, manufacturing and other types of applications. Further, in some arrangements a printer or similar device that produces a hard copy of content (from an electronic source such as a computing device) may be considered an electronic display.

Figure 4:
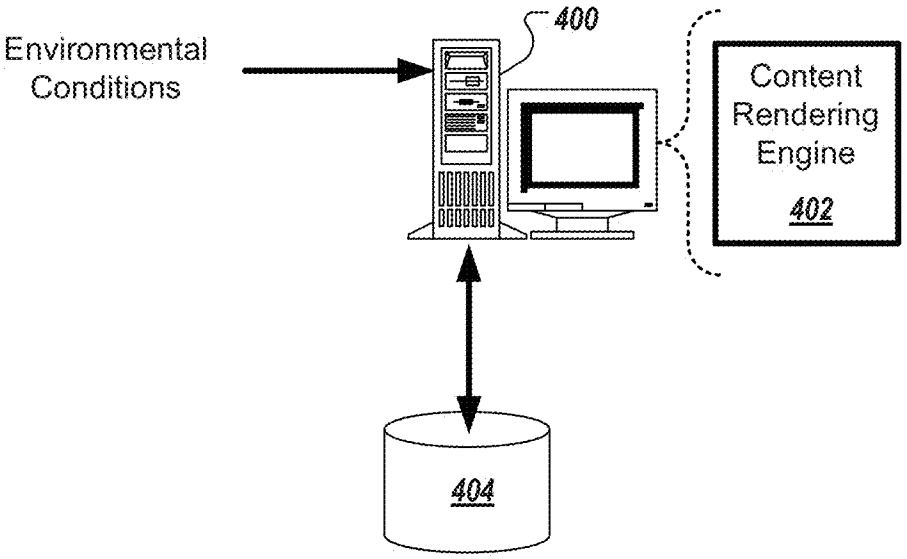
FIG. 4 illustrates a content rendering engine executed by a computing device.

Referring to FIG. 4, a computer system 400 is illustrated as including a content rendering engine 402 that is capable of adjusting the presentation of content (e.g., graphics, texts, etc.) based upon one or more environmental conditions (e.g., light levels, viewing perspective of one or more individuals, time of day, season, etc.). Information that provides the environmental conditions may be provided to the computer system, for example, substantially in real-time as being collected from one or more sensors or other information sources. Information used to determine adjustments may also reside at the computer system 400, in one or more storage devices (e.g., a storage device 404 such as a hard drive, CD-ROM, etc.), one more other types of information sources (e.g., a network connected server), etc. For example, one or more network assets (e.g., websites, web pages, etc.) may provide information (e.g., social network data) and serve as information sources. To provide this functionality the content rendering engine 402 may be provided by software, hardware, a combination of software and hardware, etc. Further, while a single computing device (e.g., located in a vehicle) may be used to provide this functionality, multiple computer systems may also be implemented (e.g., to share the computational load).

One or more techniques and methodologies may be used by the content rendering engine 402 to adjust the presentation of content. For example, the content to be presented may be adjusted to improve its legibility based upon the provided environmental conditions. Adjustments may include changes to the rendering of the content being presented. For example, for textual content, the brightness of the text may be controlled. Similarly the contrast between brighter and dimmer portions of the text may be adjusted to improve legibility. Linear and nonlinear operations associated with coding and decoding values such as luminance values (e.g., gamma correction) may similarly be adjusted for textual content. Pixel geometry and geometrical shapes associated with text (e.g., line thickness, font type, etc.) along with visual characteristics (e.g., text color, shadowing, shading, font hinting, etc.) may be adjusted by the content rendering engine 402.

The techniques and methodologies for adjusting content presentation may also include adjusting parameters of the one or more electronic displays being used to present the content. For example, lighting parameters of a display (e.g., foreground lighting levels, back lighting levels, etc.), resolution of the display, the number of bits used to represent the color of a pixel (e.g., color depth), colors associated with the display (e.g., color maps), and other parameters may be changed for adjusting the presented content.

One or more operations and algorithms may be implemented to identify appropriate adjustments for content presentation. For example, based upon the one or more of the provided environmental conditions and the content (e.g., text) to be presented, one or more substantially optimal rendering parameters may be identified along with appropriate values by the content rendering engine 402. Once identified, the parameters may be used by the computer system 400, provided to one or more other computing devices, etc. for adjusting the content for presentation on one or more electronic displays. One or more techniques may be utilized to trigger the determination of the presentation adjustments, for example, one or more detected events (e.g., user input selection, etc.) may be defined to initiate the operations of the content rendering engine 402. Adjustments may also be determined and acted upon in a predefined manner. For example, adjustments may be determined and executed in a periodic manner (e.g., every second, fraction of a second) so that a viewer (or viewers) is given an impression that environmental conditions are periodically sampled and adjustments are regularly executed. In some arrangements, the frequency of the executed adjustment may be increased such that the viewer or viewers perceive the adjustments nearly occurring in real time. Adjustments may also be executed during one or more particular time periods, for example, in a piecewise manner. For example, adjustments may be executed more frequently during time periods when experienced environmental conditions are more troublesome (e.g., lower incident angles of the sun during the summer) and less frequent during time periods when potentially dangerous environmental conditions (e.g., periods of less glare) are generally not experienced.

Figure 5:
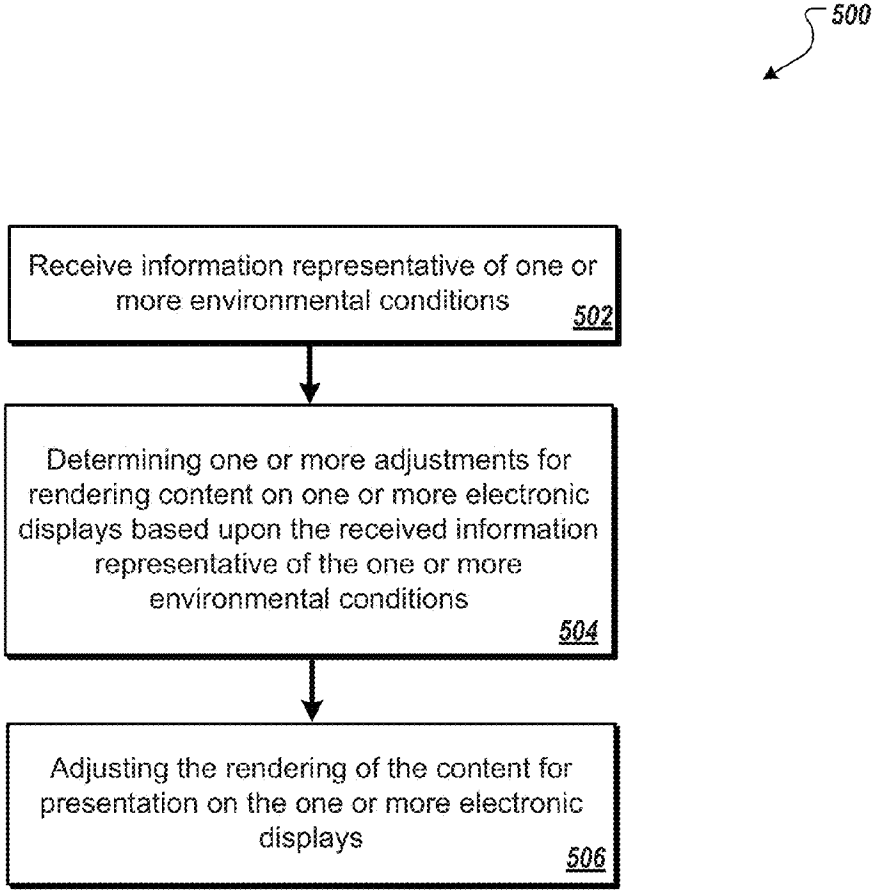
FIG. 5 is a representative flow chart of operations for adjusting the rendering of content based upon environmental conditions.

Referring to FIG. 5, a flowchart 500 represents operations of a computing device such as the computer system 400 (shown in FIG. 4) to adjust the presentation of content on one or more electronic displays (e.g., adjusting rendering of content, adjusting display parameters, etc.). Such operations, e.g., of the content rendering engine 402, are typically executed by components (e.g., processors, display controllers, etc.) included in a single computing device (e.g., the computer system 400 of FIG. 4); however, operation may be executed by multiple computing devices. Along with being executed at a single site (e.g., at the site of the computer system 400, a vehicle, etc.), operation execution may be distributed among two or more locations.

Operations may include receiving 502 information (e.g., data) representative of one or more environmental conditions. For example, the ambient light level incident upon one or more electronic displays, the position and viewing angle of one or more viewers, etc. may be received by a content rendering engine. Operations may also include determining 504 one or more adjustments for rendering content on one or more electronic displays based upon the received information representative of the one or more environmental conditions. For example, brightness, sharpness, contrast, font type, style, line width, etc. may be identified and adjusted to for rendering the content (e.g., text). Operations may also include adjusting 506 the rendering of the content for presentation on the one or more electronic displays. In some arrangements, the operations may be executed over a relatively short period of time and in a repetitive manner such that rendering adjustments may be executed nearly in real time.

Figure 6:
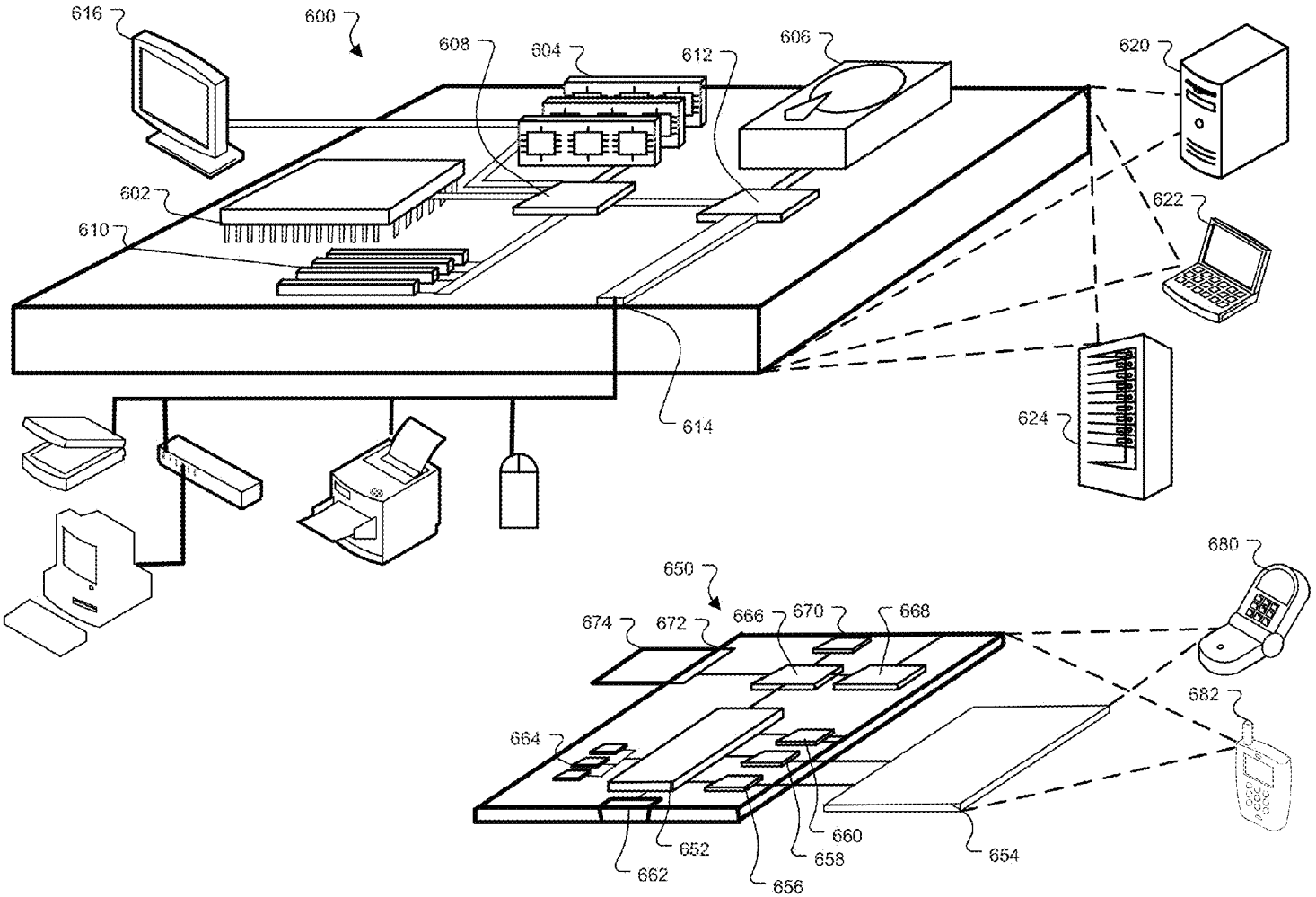
FIG. 6 is a block diagram of computing devices and systems.

FIG. 6 shows an example of example computer device 600 and example mobile computer device 650, which can be used to implement the techniques described herein. For example, a portion or all of the operations of the content rendering engine 402 may be executed by the computer device 600 and/or the mobile computer device 650. Computing device 600 is intended to represent various forms of digital computers, including, e.g., laptops, desktops, workstations, personal digital assistants, servers, blade servers, mainframes, and other appropriate computers. Computing device 650 is intended to represent various forms of mobile devices, including, e.g., personal digital assistants, cellular telephones, smartphones, and other similar computing devices. The components shown here, their connections and relationships, and their functions, are meant to be examples only, and are not meant to limit implementations of the techniques described and/or claimed in this document.

Computing device 600 includes processor 602, memory 604, storage device 606, high-speed controller 608 connecting to memory 604 and high-speed expansion ports 610, and low speed controller 612 connecting to low speed expansion port 614 and storage device 606. Each of components 602, 604, 606, 608, 610, and 612, are interconnected using various busses, and can be mounted on a common motherboard or in other manners as appropriate. Processor 602 can process instructions for execution within computing device 600, including instructions stored in memory 604 or on storage device 606 to display graphical data for a GUI on an external input/output device, including, e.g., display 616 coupled to high speed interface 608. In other implementations, multiple processors and/or multiple buses can be used, as appropriate, along with multiple memories and types of memory. Also, multiple computing devices 600 can be connected, with each device providing portions of the necessary operations (e.g., as a server bank, a group of blade servers, or a multi-processor system).

Memory 604 stores data within computing device 600. In one implementation, memory 604 is a volatile memory unit or units. In another implementation, memory 604 is a non-volatile memory unit or units. Memory 604 also can be another form of computer-readable medium, including, e.g., a magnetic or optical disk.

Storage device 606 is capable of providing mass storage for computing device 600. In one implementation, storage device 606 can be or contain a computer-readable medium, including, e.g., a floppy disk device, a hard disk device, an optical disk device, or a tape device, a flash memory or other similar solid state memory device, or an array of devices, including devices in a storage area network or other configurations. A computer program product can be tangibly embodied in a data carrier. The computer program product also can contain instructions that, when executed, perform one or more methods, including, e.g., those described above. The data carrier is a computer- or machine-readable medium, including, e.g., memory 604, storage device 606, memory on processor 602, and the like.

High-speed controller 608 manages bandwidth-intensive operations for computing device 600, while low speed controller 612 manages lower bandwidth-intensive operations. Such allocation of functions is an example only. In one implementation, high-speed controller 608 is coupled to memory 604, display 616 (e.g., through a graphics processor or accelerator), and to high-speed expansion ports 610, which can accept various expansion cards (not shown). In the implementation, low-speed controller 612 is coupled to storage device 606 and low-speed expansion port 614. The low-speed expansion port, which can include various communication ports (e.g., USB, BLUETOOTH®, Ethernet, wireless Ethernet), can be coupled to one or more input/output devices, including, e.g., a keyboard, a pointing device, a scanner, or a networking device including, e.g., a switch or router, e.g., through a network adapter.

Computing device 600 can be implemented in a number of different forms, as shown in the figure. For example, it can be implemented as standard server 620, or multiple times in a group of such servers. It also can be implemented as part of rack server system 624. In addition or as an alternative, it can be implemented in a personal computer including, e.g., laptop computer 622. In some examples, components from computing device 600 can be combined with other components in a mobile device (not shown), including, e.g., device 650. Each of such devices can contain one or more of computing device 600, 650, and an entire system can be made up of multiple computing devices 600, 650 communicating with each other.

Computing device 650 includes processor 652, memory 664, an input/output device including, e.g., display 654, communication interface 666, and transceiver 668, among other components. Device 650 also can be provided with a storage device, including, e.g., a microdrive or other device, to provide additional storage. Each of components 650, 652, 664, 654, 666, and 668, are interconnected using various buses, and several of the components can be mounted on a common motherboard or in other manners as appropriate.

Processor 652 can execute instructions within computing device 650, including instructions stored in memory 664. The processor can be implemented as a chipset of chips that include separate and multiple analog and digital processors. The processor can provide, for example, for coordination of the other components of device 650, including, e.g., control of user interfaces, applications run by device 650, and wireless communication by device 650.

Processor 652 can communicate with a user through control interface 658 and display interface 656 coupled to display 654. Display 654 can be, for example, a TFT LCD (Thin-Film-Transistor Liquid Crystal Display) or an OLED (Organic Light Emitting Diode) display, or other appropriate display technology. Display interface 656 can comprise appropriate circuitry for driving display 654 to present graphical and other data to a user. Control interface 658 can receive commands from a user and convert them for submission to processor 652. In addition, external interface 662 can communicate with processor 642, so as to enable near area communication of device 650 with other devices. External interface 662 can provide, for example, for wired communication in some implementations, or for wireless communication in other implementations, and multiple interfaces also can be used.

Memory 664 stores data within computing device 650. Memory 664 can be implemented as one or more of a computer-readable medium or media, a volatile memory unit or units, or a non-volatile memory unit or units. Expansion memory 674 also can be provided and connected to device 650 through expansion interface 672, which can include, for example, a SIMM (Single In Line Memory Module) card interface. Such expansion memory 674 can provide extra storage space for device 650, or also can store applications or other data for device 650. Specifically, expansion memory 674 can include instructions to carry out or supplement the processes described above, and can include secure data also. Thus, for example, expansion memory 674 can be provided as a security module for device 650, and can be programmed with instructions that permit secure use of device 650. In addition, secure applications can be provided through the SIMM cards, along with additional data, including, e.g., placing identifying data on the SIMM card in a non-hackable manner.

The memory can include, for example, flash memory and/or NVRAM memory, as discussed below. In one implementation, a computer program product is tangibly embodied in a data carrier. The computer program product contains instructions that, when executed, perform one or more methods, including, e.g., those described above. The data carrier is a computer- or machine-readable medium, including, e.g., memory 664, expansion memory 674, and/or memory on processor 652, which can be received, for example, over transceiver 668 or external interface 662.

Device 650 can communicate wirelessly through communication interface 666, which can include digital signal processing circuitry where necessary. Communication interface 666 can provide for communications under various modes or protocols, including, e.g., GSM voice calls, SMS, EMS, or MMS messaging, CDMA, TDMA, PDC, WCDMA, CDMA2000, or GPRS, among others. Such communication can occur, for example, through radio-frequency transceiver 668. In addition, short-range communication can occur, including, e.g., using a BLUETOOTH®, WIFI, or other such transceiver (not shown). In addition, GPS (Global Positioning System) receiver module 670 can provide additional navigation- and location-related wireless data to device 650, which can be used as appropriate by applications running on device 650.

Device 650 also can communicate audibly using audio codec 660, which can receive spoken data from a user and convert it to usable digital data. Audio codec 660 can likewise generate audible sound for a user, including, e.g., through a speaker, e.g., in a handset of device 650. Such sound can include sound from voice telephone calls, can include recorded sound (e.g., voice messages, music files, and the like) and also can include sound generated by applications operating on device 650.

Computing device 650 can be implemented in a number of different forms, as shown in the figure. For example, it can be implemented as cellular telephone 680. It also can be implemented as part of smartphone 682, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms machine-readable medium and computer-readable medium refer to a computer program product, apparatus and/or device (e.g., magnetic discs, optical disks, memory, Programmable Logic Devices (PLDs)) used to provide machine instructions and/or data to a programmable processor, including a machine-readable medium that receives machine instructions.

To provide for interaction with a user, the systems and techniques described here can be implemented on a computer having a display device (e.g., a CRT (cathode ray tube) or LCD (liquid crystal display) monitor) for displaying data to the user and a keyboard and a pointing device (e.g., a mouse or a trackball) by which the user can provide input to the computer. Other kinds of devices can be used to provide for interaction with a user as well; for example, feedback provided to the user can be a form of sensory feedback (e.g., visual feedback, auditory feedback, or tactile feedback); and input from the user can be received in a form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a user interface or a Web browser through which a user can interact with an implementation of the systems and techniques described here), or a combination of such back end, middleware, or front end components. The components of the system can be interconnected by a form or medium of digital data communication (e.g., a communication network). Examples of communication networks include a local area network (LAN), a wide area network (WAN), and the Internet.

The computing system can include clients and servers. A client and server are generally remote from each other and typically interact through a communication network. The relationship of client and server arises by virtue of computer programs running on the respective computers and having a client-server relationship to each other.

In some implementations, the engines described herein can be separated, combined or incorporated into a single or combined engine. The engines depicted in the figures are not intended to limit the systems described here to the software architectures shown in the figures.

A number of embodiments have been described. Nevertheless, it will be understood that various modifications can be made without departing from the spirit and scope of the processes and techniques described herein. In addition, the logic flows depicted in the figures do not require the particular order shown, or sequential order, to achieve desirable results. In addition, other steps can be provided, or steps can be eliminated, from the described flows, and other components can be added to, or removed from, the described systems. Accordingly, other embodiments are within the scope of the following claims.

What is claimed is:

1. A computing device-implemented method comprising:

receiving information representative of one or more environmental conditions from at least one of a sensor and user input;

determining in a periodic manner, at a computing device, one or more pixel level adjustments for rendering content on one or more electronic displays connected to the computing device based upon the received information representative of the one or more environmental conditions, the periodic manner being set by an adjustable frequency determined from the one or more environmental conditions, wherein determining the one or more pixel level adjustments for content rendering is different from determining display parameter adjustments of the one more electronic displays, the display parameter adjustments include adjusting display brightness of the one or more electronic displays, at least two of the pixel level adjustments include adjusting visual characteristics and adjusting geometrical shapes for content rendering; and adjusting the rendering of the content at the pixel level prior to presentation, on the one or more electronic displays connected to the computing device, while maintaining the content to be presented on the one or more electronic displays based upon the received information representing the one or more environmental conditions.

2. The computing device-implemented method of claim 1, wherein adjusting the rendering of the content at the pixel level includes adjusting one or more rendering parameters.

3. The computing device-implemented method of claim 1, wherein the content for being presented on the at least one display includes graphics.

4. The computing device-implemented method of claim 1, wherein the content for being presented on the at least one display includes text.

5. The computing device-implemented method of claim 1, wherein at least one of the environmental conditions represents ambient light.

6. The computing device-implemented method of claim 1, wherein at least one of the environmental conditions represents an artificial light source.

7. The computing device-implemented method of claim 6, wherein the artificial light source is a computing device.

8. The computing device-implemented method of claim 1, wherein the one or more electronic displays includes a printer.

9. The computing device-implemented method of claim 1, wherein a light sensor collects at least one of the environmental conditions and provides a signal for setting the periodic manner.

10. A system comprising:

a computing device comprising:

a memory configured to store instructions; and a processor to execute the instructions to perform a method comprising:

receiving information representative of one or more environmental conditions from at least one of a sensor and user input, determining in a periodic manner, at the computing device, one or more pixel level adjustments for rendering content on one or more electronic displays connected to the computing device based upon the received information representative of the one or more environmental conditions, the periodic manner being set by an adjustable frequency determined from the one or more environmental conditions, wherein determining the one or more pixel level adjustments for content rendering is different from determining display parameter adjustments of the one or more electronic displays, the display parameter adjustments include adjusting display brightness of the one or more electronic displays, at least two of the pixel level adjustments include adjusting visual characteristics and adjusting geometrical shapes for content rendering, and adjusting the rendering of the content at the pixel level prior to presentation, one the one or more electric displays connected to the computing device, while maintaining the content to be presented on the one or more electronic displays based upon the received information representing the one or more environmental conditions.

11. The system of claim 10, wherein adjusting the rendering of the content at the pixel level includes adjusting one or more rendering parameters.

12. The system of claim 10, wherein the content for being presented on the at least one display includes graphics.

13. The system of claim 10, wherein the content for being presented on the at least one display includes text.

14. The system of claim 10, wherein at least one of the environmental conditions represents ambient light.

15. The system of claim 10, wherein at least one of the environmental conditions represents an artificial light source.

16. The system of claim 15, wherein the artificial light source is a computing device.

17. The system of claim 10, wherein the one or more electronic displays includes a printer.

18. The system of claim 10, wherein a light sensor collects at east one of the environmental conditions and provides a signal for setting the periodic manner.

19. One or more computer readable storage devices storing instructions that are executable by a processing device, and upon such execution cause the processing device to perform operations comprising:

receiving information representative of one or more environmental conditions from at least one of a sensor and user input;

determining in a periodic manner, at a computer, one or more pixel level adjustments for rendering content on one or more electronic displays connected to the computer based upon the received information representative of the one or more environmental conditions, the periodic manner being set by an adjustable frequency determined from the one or more environmental conditions, wherein determining the one or more pixel level adjustments for content rendering is different from determining display parameter adjustments of the one or more electronic displays, the display parameter adjustments include adjusting display brightness of the one or more electronic displays, at two of the pixel level adjustments include adjusting visual characteristics and adjusting geometrical shapes for content rendering; and adjusting the rendering of the content at the pixel level prior to presentation, on the one or more electronic displays connected to the computing device, while maintaining the content to be presented on the one or more electronic displays based upon the received information representing the one or more environmental conditions.

20. The computer readable storage devices of claim 19, wherein adjusting the rendering of the content at the pixel level includes adjusting one or more rendering parameters.

21. The computer readable storage devices of claim 19, wherein the content for being presented on the at least one display includes graphics.

22. The computer readable storage devices of claim 19, wherein the content for being presented on the at least one display includes text.

23. The computer readable storage devices of claim 19, wherein at least one of the environmental conditions represents ambient light.

24. The computer readable storage devices of claim 19, wherein at least one of the environmental conditions represents an artificial light source.

25. The computer readable storage devices of claim 24, wherein the artificial light source is a computing device.

26. The computer readable storage devices of claim 19, wherein the one or more electronic displays includes a printer.

27. The computer readable storage devices of claim 19, wherein a light sensor collects at least one of the environmental conditions and provides a signal for setting the periodic manner.

* * * * *